US008012036B2

(12) United States Patent
Nakamura

(10) Patent No.: US 8,012,036 B2
(45) Date of Patent: Sep. 6, 2011

(54) IRON-TYPE GOLF CLUB SET

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 164 days.

(21) Appl. No.: 12/502,131

(22) Filed: Jul. 13, 2009

(65) Prior Publication Data

US 2010/0029401 A1 Feb. 4, 2010

(30) Foreign Application Priority Data

Aug. 1, 2008 (JP) ..... 2008-199937

(51) Int. Cl.
*A63B 53/04* (2006.01)

(52) U.S. Cl. ..... 473/290; 473/331; 473/350

(58) Field of Classification Search ..... 473/290, 473/330–331, 350
See application file for complete search history.

(56) References Cited

U.S. PATENT DOCUMENTS

| | | | | |
|---|---|---|---|---|
| 1,965,954 | A * | 7/1934 | Davis | 473/242 |
| 5,437,088 | A * | 8/1995 | Igarashi | 29/527.6 |
| 7,695,377 | B2 * | 4/2010 | Yamagishi et al. | 473/331 |
| 7,758,449 | B2 * | 7/2010 | Gilbert et al. | 473/330 |
| 7,918,747 | B2 * | 4/2011 | Johnson et al. | 473/328 |
| 2008/0125241 | A1 * | 5/2008 | Tateno et al. | 473/331 |
| 2008/0132352 | A1 * | 6/2008 | Ban | 473/331 |
| 2009/0176597 | A1 * | 7/2009 | Yamagishi et al. | 473/331 |
| 2009/0264217 | A1 * | 10/2009 | Johnson et al. | 473/331 |
| 2009/0305812 | A1 * | 12/2009 | Nakamura | 473/331 |
| 2009/0318243 | A1 * | 12/2009 | Golden et al. | 473/331 |
| 2010/0029405 | A1 * | 2/2010 | Gilbert | 473/331 |
| 2010/0113180 | A1 * | 5/2010 | Nakamura | 473/331 |
| 2010/0285898 | A1 * | 11/2010 | Gilbert et al. | 473/331 |
| 2011/0086725 | A1 * | 4/2011 | Yamagishi et al. | 473/331 |

FOREIGN PATENT DOCUMENTS

JP 2008-005994 A 1/2008

* cited by examiner

*Primary Examiner* — Stephen L. Blau
(74) *Attorney, Agent, or Firm* — Birch, Stewart, Kolasch & Birch, LLP

(57) ABSTRACT

A set of iron-type golf clubs comprising "n" pieces of golf clubs having club heads with different loft angles and having advantages that variation in spin amount at mis-shots by long irons is small and accuracy in shots of intentionally curving a ball by short irons is high, each of the club heads having face 4 provided with a plurality of face grooves 10 extending in the toe-heel direction and a plurality of auxiliary grooves 11 including a plurality of first auxiliary grooves 11*a* extending in at least a region between toe side line L1 and heel side line L2, the first auxiliary grooves 11*a* being, in this region, in the form of curved grooves convex upward such that a curve descends from peak 13 toward the toe and heel side lines L1 and L2, and average degrees of curvature θi of the first auxiliary grooves of the club heads satisfying a specific relationship.

11 Claims, 10 Drawing Sheets

IRON-TYPE GOLF CLUB SET

BACKGROUND OF THE INVENTION

The present invention relates to a set of iron-type golf clubs capable of reducing variation in spin amount at mis-shots for long iron clubs and capable of increasing accuracy in shots intentionally curving a ball for short iron clubs.

In order to increase flight distance of a ball by optimizing a frictional condition of a face, JP 2008-005994 proposes an iron-type golf club head having a face provided with a plurality of face grooves extending in a toe-heel direction and having a depth of 0.200 to 0.508 mm and a plurality of auxiliary grooves having a depth of 0.005 to 0.025 mm.

In order to effectively exhibit the action of the auxiliary grooves, the present inventor made a study about actual use of iron-type golf club heads having different loft angles.

So-called long irons having a small loft angle are generally used for hitting a ball straight with a stance square to a distant target. Therefore, in case of the long irons, shots to intentionally curve a ball greatly or shots to cut across a ball with a clubface opened are not so frequent. Further, such shots by the long irons may be technically difficult, since a club head of the long irons is relatively small. On the other hand, probability of mis-shots by long irons such as hitting on a toe or heel side of a face is relatively high, since the length of the clubs is relatively large.

So-called short irons having a large loft angle are generally used to carry a ball from the periphery of a green, a bunker, a rough and so on to a relatively near target such as a green. Therefore, in order to avoid an obstacle, there are frequently conducted so-called intentional shots wherein a ball is hit in the state that a clubface is opened or closed to intentionally curve the ball. Since a club head of the short irons is relatively large, such a use is technically easy. Further, since the length of the short iron club is relatively small, probability of mis-shots by short irons such as hitting on a toe or heel side of a face is lower than the long irons.

Like this, there are cases where main purpose and status of use are different between long irons and short irons.

It is an object of the present invention to provide a set of iron-type golf clubs wherein long irons are capable of reducing variation in spin amount at mis-shots, thereby stabilizing the flight distance, and short irons are capable of imparting a sufficient spin amount to a ball even at intentional shots for intentionally curving a ball, thereby increasing accuracy of shots by short irons.

This and other objects of the present invention will become apparent from the description hereinafter.

SUMMARY OF THE INVENTION

In effectively exhibiting the action of auxiliary grooves as proposed in the above-mentioned prior art, it would be effective for the long irons to make the auxiliary grooves function to reduce variation in backspin amount of ball at mis-shots, thereby stabilizing the flight distance. On the other hand, it would be effective for the short irons to make the auxiliary grooves function to impart a sufficient backspin amount to a ball even at the intentional shots.

The present invention has been made based on such a consideration. It has been found that the object of the present invention can be achieved when the auxiliary grooves are formed into curved grooves convex upward and the average degree of curvature of the curved grooves is varied depending on loft angles of club heads.

In accordance with the present invention, there is provided a set of iron-type golf clubs comprising "n" pieces of iron-type golf clubs having club heads with different loft angles wherein "n" is an integer of 3 or more, each of the club heads having a ball-hitting face provided with a plurality of face grooves extending in a club head's toe-heel direction and having a depth of 0.200 to 0.508 mm and a plurality of auxiliary grooves having a depth of 0.005 to 0.025 mm, the auxiliary grooves including a plurality of first auxiliary grooves extending, in a vertically-placed face state that a club head is placed on horizontal plane at prescribed line and loft angles given to the club head and is then tilted forward up to a loft angle of 0°, in at least a region between a toe side line extending at right angles to the face grooves with passing at toe side ends of the face grooves and a heel side line extending at right angles to the face grooves with passing at heel side ends of the face grooves, each of the first auxiliary grooves being formed, in said region, into a curved groove convex upward such that a curve descends from a peak toward both the toe side line and the heel side line, and an average degree of curvature θi calculated according to the following equation (1) of the first auxiliary grooves of each of the club heads satisfying the following equations (2) and (3):

$$\theta i=\Sigma\{(H1j-H2j)/W\}/m \ (j=1 \text{ to } m) \quad (1)$$

$$\theta 1<\theta n \quad (2)$$

$$\theta 1\leqq\theta 2\leqq \ldots \leqq\theta n \quad (3)$$

wherein:

H1*j* is a height of the peak of a j-th first auxiliary groove from the horizontal plane, H2*j* is an average value between a height H2*aj* from the horizontal plane of an intersection point of the j-th first auxiliary groove with the toe side line and a height H2*bj* from the horizontal plane of an intersection point of the j-th first auxiliary groove with the heel side line {H2*j*=(H2*aj*+H2*bj*)/2}, W is a horizontal distance between the toe side line and the heel side line, "m" is a total number of the first auxiliary grooves included in each of the club heads, and θi is an average degree of curvature of the first auxiliary grooves of each of the club heads, and the suffix "i" is an integer of 1 to "n" given to the club heads in order of loft angle from a club head having the smallest loft angle, in which "n" is a total number of the golf clubs included in the golf club set.

Preferably, the average degree of curvature θi satisfies the following equation (4):

$$\theta 1<\theta 2< \ldots <\theta n \quad (4)$$

Preferably, the first auxiliary grooves are in the form of an arc.

Preferably, the average degree of curvature θ1 of the club head having the smallest loft angle is from 0.02 to 0.10, and the average degree of curvature θn of the club head having the largest loft angle is from 0.11 to 0.35.

Preferably, a ratio θn/θ1 of the average degree of curvature θn of the club head having the largest loft angle to the average degree of curvature θ1 of the club head having the smallest loft angle is from 1.5 to 7.5.

In the present invention, the auxiliary grooves includes a plurality of the first auxiliary grooves extending in an area between the toe side and heel side lines which define a substantial effective hitting area of the face. The first auxiliary grooves are formed into upwardly convex curved grooves so that the average degree of curvature θi of the first auxiliary grooves of each of the club heads calculated according to the following equation (1) satisfies the following equations (2) and (3).

$$\theta i=\Sigma\{(H1j-H2j)/W\}/m \ (j=1 \text{ to } m) \quad (1)$$

$$\theta 1<\theta n \quad (2)$$

$$\theta 1\leqq\theta 2\leqq \ldots \leqq\theta n \quad (3)$$

By the equation (1) is calculated the average degree of curvature θi of the first auxiliary grooves of each club head included in the golf club set. The larger the average degree of curvature θi, each of the first auxiliary grooves curves more sharply and extends at a larger angle to the toe-heel direction on toe side and heel side of the face. To the contrary, the smaller the average degree of curvature θi, each of the first auxiliary grooves curves gently and extends at a smaller angle to the toe-heel direction on the toe side and heel side of the face.

According to the equations (2) and (3), the golf club set of the present invention can be prepared so that the smaller the loft angle (i.e., long irons), the smaller the average degree of curvature θi of the first auxiliary grooves, and the larger the loft angle (i.e., short irons), the larger the average degree of curvature θi of the first auxiliary grooves.

In case of long irons, mis-shots such as toe hit and heel hit are easy to occur. In such mis-shots, a golf ball moves on the face in a direction as shown by an arrow A or B in FIG. 1A. The angle of the moving direction to a vertical direction (i.e., direction perpendicular to face grooves 10) is relatively small. In contrast, in case of short irons, a golf ball is frequently hit with a face intentionally opened or closed greatly. In such shots, a golf ball moves on the face in a direction as shown by an arrow C or D in FIG. 1C. The angle of the moving direction C or D to a vertical direction (i.e., direction perpendicular to face grooves 10) is larger than that of the long irons.

In a preferable embodiment of the present invention, since the long irons include the first auxiliary grooves having a smaller average degree of curvature θi and the short irons include the first auxiliary grooves having a larger average degree of curvature θi, the first auxiliary grooves are arranged in respective golf clubs at an angle approaching right angle to the ball moving directions A to D. Therefore, even in the case of mis-shots by long irons, variation in spin amount of ball can be reduced to stabilize the flight distance. Further, even in the case of intentional shots by short irons, the amount of spin can be increased to enhance the accuracy of shots.

DETAILED DESCRIPTION OF THE INVENTION

An embodiment of the present invention will now be explained with reference to the accompanying drawings.

Figure 1A:
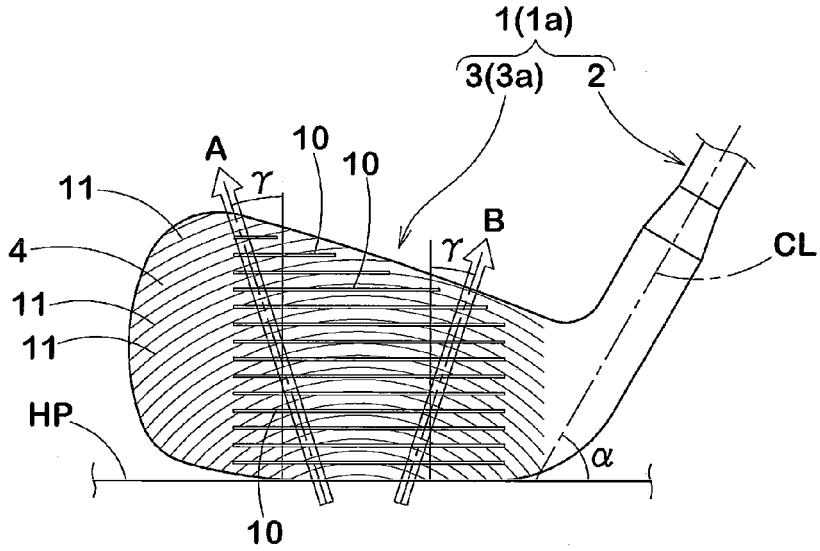
FIGS. 1A to 1C are front views of a golf club set showing an embodiment of the present invention.
Figure 1B:
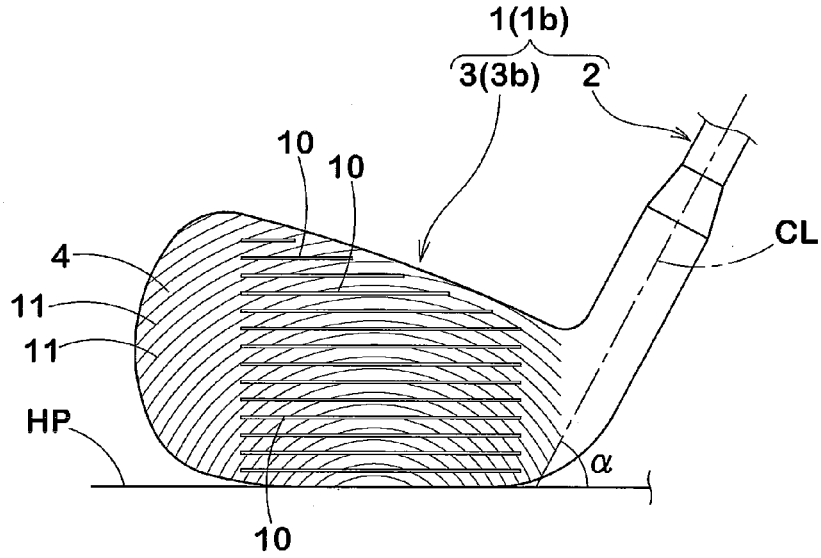
Figure 1C:
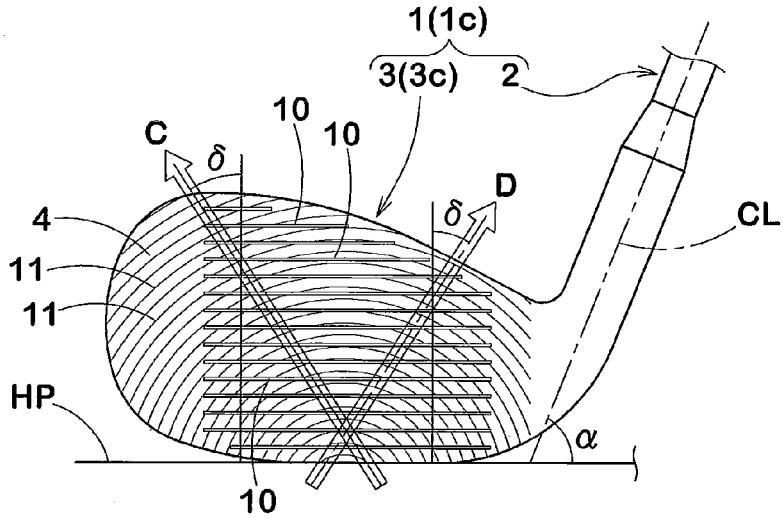
Figure 2A:
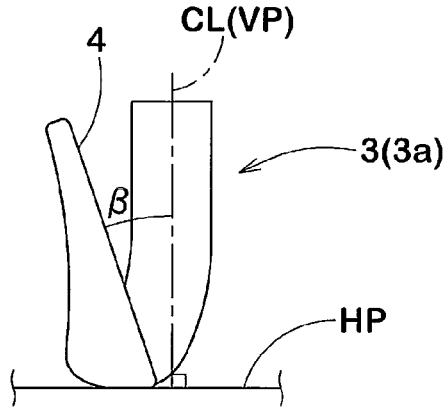
FIGS. 2A to 2C are side views of the golf clubs of FIGS. 1A to 1C.
Figure 2B:
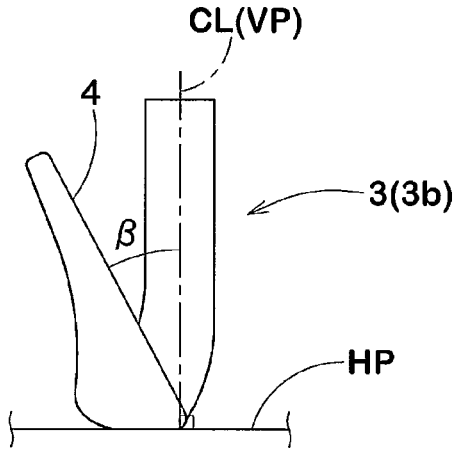
Figure 2C:
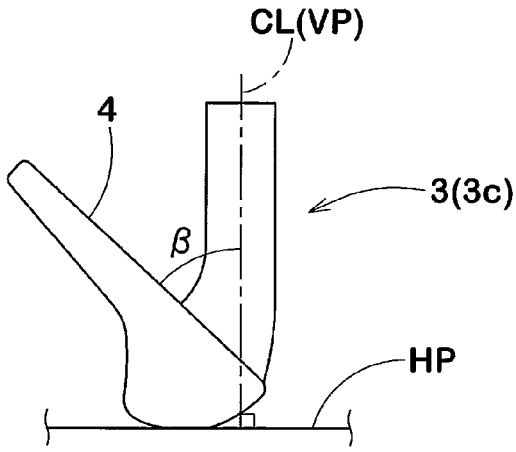

FIGS. 1A to 1C are front views of three golf clubs 1*a* to 1*c* included in an iron-type golf club set according to the present invention, which are placed in a standard state, and FIGS. 2A to 2C are side views of these golf clubs 1*a* to 1*c* viewed from toe sides of club heads 3.

The term "standard state" of a golf club as used herein denotes the state that the club head 3 is placed on a horizontal plane HP in the state that a center line CL of a shaft 2 is disposed in an arbitrary vertical plane VP and is inclined at a prescribed lie angle α and, on the other hand, a club face 4 of the club head 3 is inclined at a prescribed loft angle β with respect to the vertical plane VP.

The iron-type golf club set of the present invention comprises "n" pieces of iron-type golf clubs 1*a*, 1*b*, 1*c* . . . having club heads with different loft angles β wherein "n" is an integer of 3 or more, that is to say, the set comprises at least three iron-type golf clubs having different loft angles β.

The loft angles β are not particularly limited, but from the viewpoint that a shot distance achievable by the golf club set of the invention covers a wide range, it is preferable that the lowest loft angle β in the golf club set is from 19 to 27°, especially 21 to 26°, and the largest loft angle β in the golf club set is from 44 to 60°, especially 46 to 57°.

In order to allow a player to achieve a desired flight distance accurately, it is preferable that a difference in loft angle between two iron clubs with adjacent club numbers in the golf club set, e.g., between 5-iron and 6-iron, or between 8-iron and 9-iron, is from about 3 to about 10.

The total number of golf clubs included in the golf club set of the present invention is at least three, but the golf club set may comprise 5 to 10 clubs, or 6 to 8 clubs, according to a practice. In this embodiment shown in the drawings, shafts 2 attached to respective club heads 3 have lengths gradually decreasing as the loft angle increases. Further, the lie angles α of the club heads 3 gradually increase as the loft angle β increases.

In FIG. 1A is shown a 3-iron (long iron) having the smallest loft angle of iron-type golf clubs (loft angle β in this embodiment being 21°). In FIG. 1C is shown a pitching wedge having the largest loft angle among short irons in this embodiment (loft angle β in this embodiment being 51°). In FIG. 1B is shown a 6-iron (middle iron) having a loft angle between the 3-iron and the pitching wedge (loft angle β in this embodiment being 27°).

Figure 3:
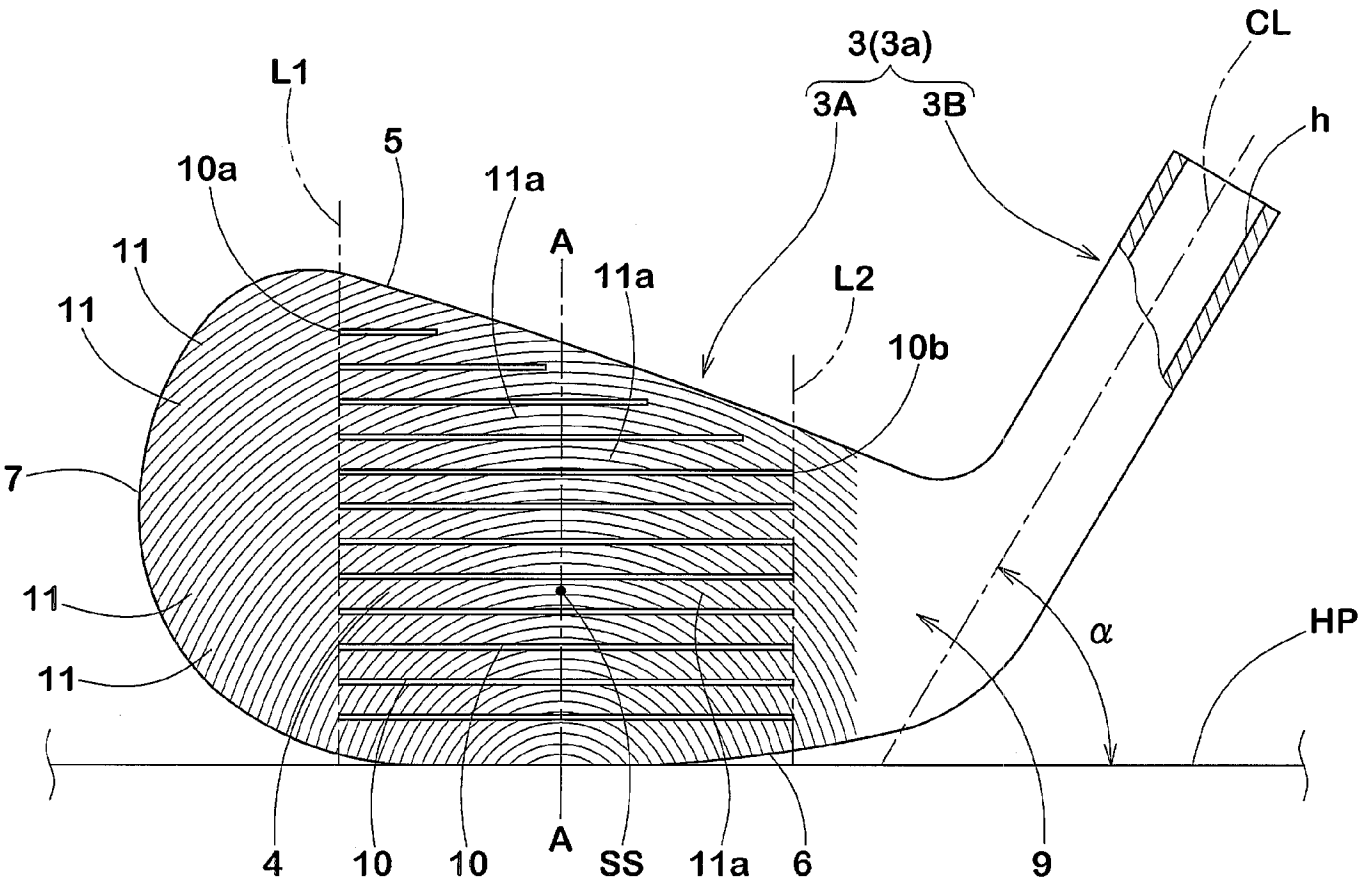
FIG. 3 is a front view of a club head.
Figure 4:
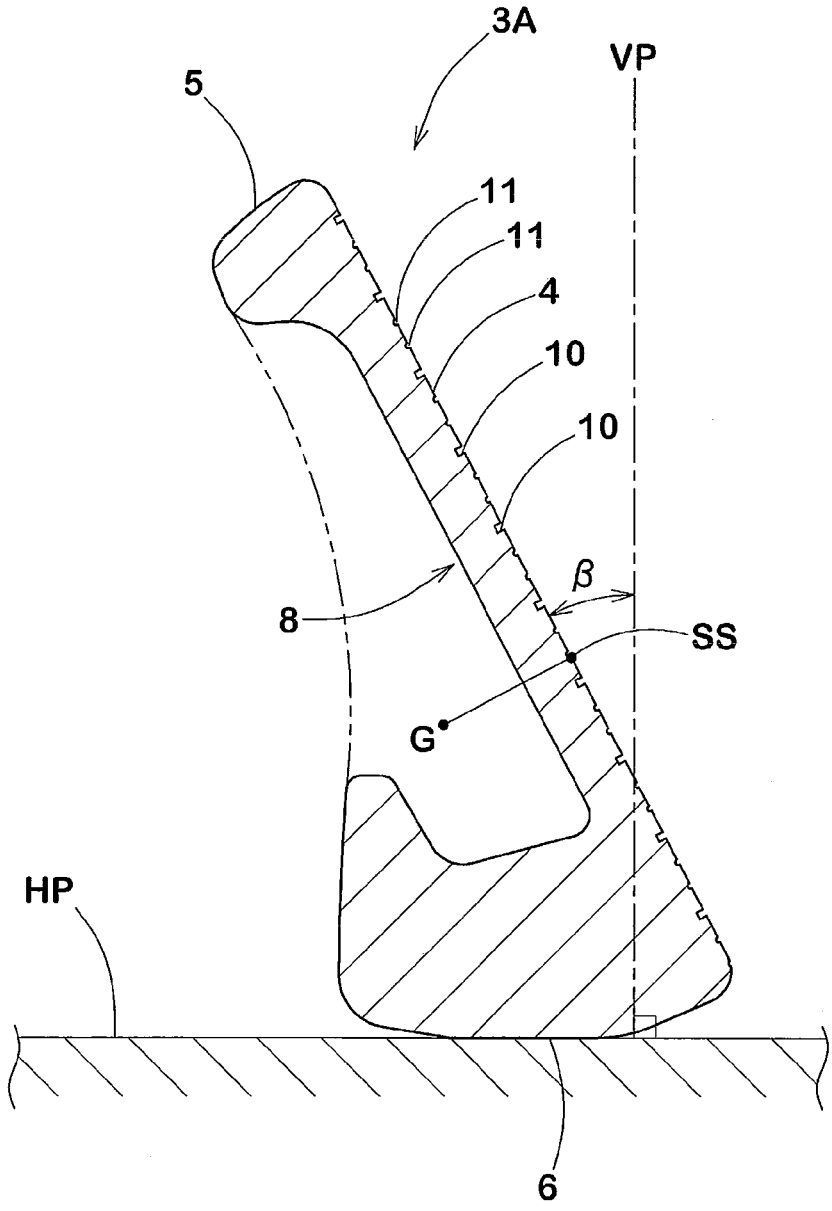
FIG. 4 is a cross sectional view along the line A-A of FIG. 3.

FIG. 3 shows an enlarged front view of the club head 3*a* of FIG. 1A as a representative example, and FIG. 4 shows a cross sectional view along the line A-A of FIG. 3.

Each of the club heads 3 is made of a metallic material, and it includes a face portion 3A and a hosel portion 3B having an approximately cylindrical shape which is formed integrally with the face portion 3A through a neck portion 9 and which has a shaft inserting hole "h" for inserting a shaft 2.

Known metallic materials used in this field can be used in the present invention. Preferable examples of the metallic material are, for instance, a soft iron, a stainless steel, a marageing steel, a titanium alloy, and the like. The metallic materials may be used alone or in combinations thereof. The club head 3 can be produced, for example, by casting, forging, or pressing of rolled material.

The face portion 3A comprises a face 4 for hitting a golf ball, a top 5 which intersects with the face 4 at its upper edge and forms a head upper surface inclining downward from a toe side toward a heel side, a sole 6 which intersects with the face 4 at its lower edge and extends nearly horizontally in the toe-heel direction to form the bottom surface of the head 3, a toe 7 connecting the top 5 and the sole 6 on the toe side to form a toe portion of the head 3, and a back face 8 which is a face on the side opposite to the face 4.

In order to enhance a friction with a golf ball, the face 4 is provided with a plurality of face grooves 10 as impact area markings and a plurality of auxiliary grooves 11. The face 4 is formed as a substantially single plane when macroscopically viewed excepting the face grooves and the auxiliary grooves.

The face grooves 10 are composed of a plurality of grooves formed at intervals in the up-down direction of head to extend in the toe-heel direction. Here, the phrase "extend in the toe-heel direction" denotes such an extent that the face grooves 10 are recognized to lie approximately along the toe-heel direction when they are visually observed in the standard state. Specifically, it is at least acceptable that face grooves 10 inclines at an angle of at most ±2°, especially about ±1°, with respect to the toe-heel direction when the head 3 in the standard state is viewed from the front side.

The face grooves 10 are disposed in a central area of the face 4, i.e., a portion other than a toe side area and a heel side area of the face 4, whereby a player can visually recognize a suitable impact area.

A straight line extending on the face 4 at right angles to the face grooves 10 with passing at toe side ends 10*a* of the face grooves 10 is herein referred to as a toe side line L1, and a straight line extending on the face 4 at right angles to the face grooves 10 with passing at heel side ends 10*b* of the face grooves 10 is referred to as a heel side line L2. These lines L1 and L2 may be a line depicted as a pattern, or a line as visually appearing as a result of forming a pattern on the face or a difference in roughness of a surface, or they may be an imaginary line.

A sweet spot SS is disposed in an area between the toe side line L1 and the heel side line L2. As shown in FIG. 4, the sweet spot SS is a point where a vertical line drawn to the face 4 from the center of gravity G of the club head 3 intersects the face 4. Therefore, the face grooves 10 in this embodiment extend to cross the central area including the sweet spot SS. Preferably, the sweet spot SS is disposed in approximately the middle (deviation of ±5% being permissible) between the toe side and heel side lines L1 and L2.

Figure 5:
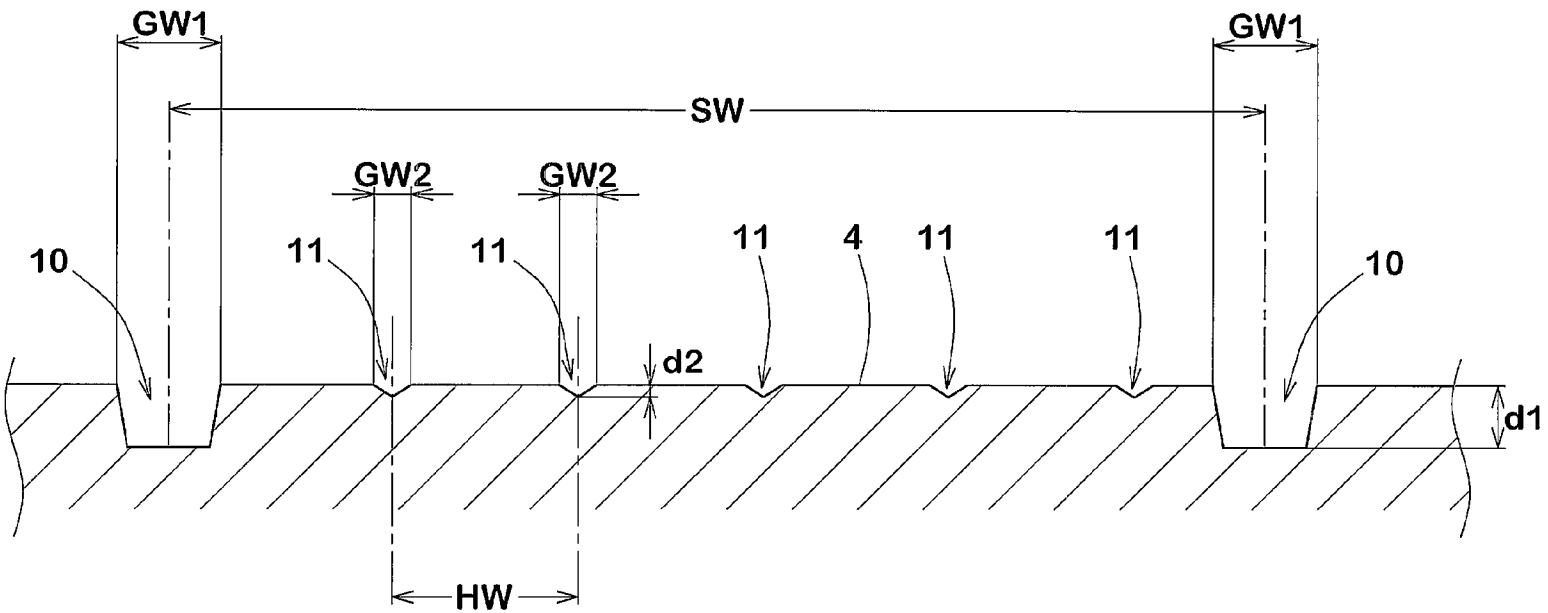
FIG. 5 is an enlarged cross sectional view of a face of a club head according to the present invention.

The face grooves 10 have a depth d1 of 0.200 to 0.508 mm, as shown in FIG. 5 in an enlarged manner. If the depth d1 is less than 0.200 mm, a friction between the face 4 and a ball cannot be sufficiently enhanced. Further, if no such face grooves are not provided, a ball will slip on the face when playing in the rain, resulting in mis-shot. From such points of view, the depth d1 of the face grooves 10 is preferably at least 0.250 mm, more preferably at least 0.300 mm, still more preferably at least 0.350 mm. On the other hand, if the depth d1 exceeds 0.508 mm, besides violation of the R&A golf rules, a ball is easy to get scratched at impact. Therefore, the depth d1 of the face grooves 10 is preferably at most 0.500 mm, more preferably at most 0.480 mm, still more preferably at most 0.450 mm.

Sectional shape and width GW1 of the face grooves 10 and a pitch SW of disposing the face grooves 10 (i.e., distance between center lines of adjacent face grooves) should be determined so as not to violate the golf rules.

The face grooves 10 in this embodiment have an angular shape, but the sectional shape of the face grooves 10 is not limited to angular shapes. The face grooves 10 can have various cross section shapes, e.g., approximately trapezoidal shape having a width decreasing toward the groove bottom, V-shape and arc shape, so long as the cross section is symmetrical.

Figure 6A:
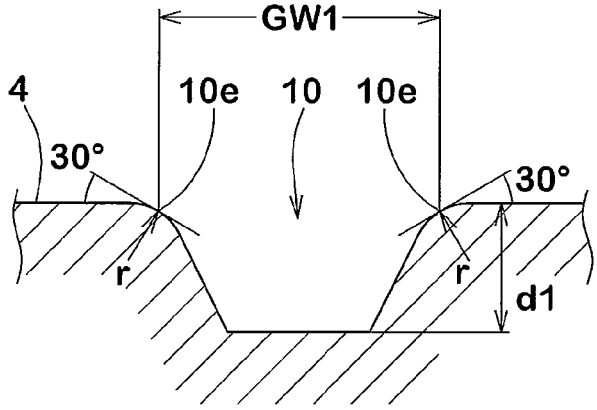
FIGS. 6A to 6C are enlarged cross sectional views of face grooves.
Figure 6B:
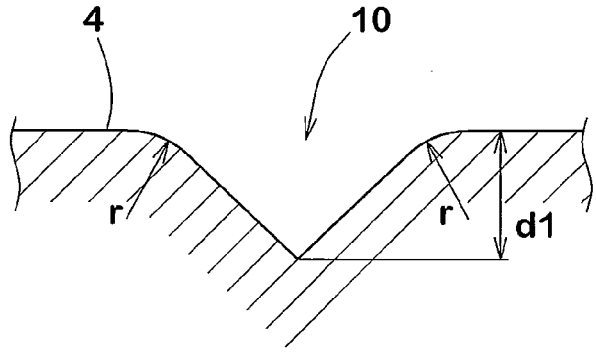
Figure 6C:
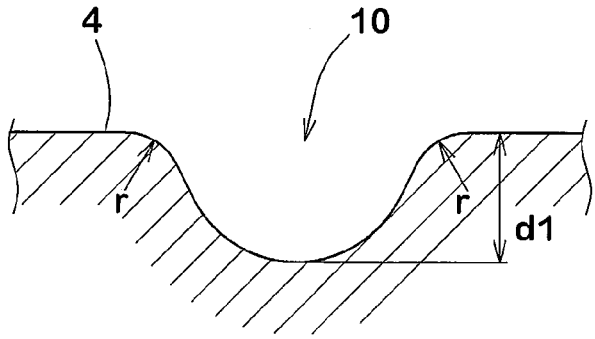

As shown in FIG. 6, edges of the face grooves 10 are chamfered into round edges having a radius "r" of at most 0.020 inch (0.508 mm) according to the golf rules. The radius of curvature "r" of a roundness (circular arc in section) of the edges of face grooves 10 is preferably from 0.14 to 0.18 mm.

The width GW1 of the face grooves 10 is set to 0.90 mm or less according to the golf rules. In order to prevent the contact area between the face 4 and a ball from decreasing, the width GW1 is preferably at most 0.85 mm, more preferably at most 0.80 mm. On the other hand, in order to cause the face grooves to exhibit a frictional force surely to thereby impart a sufficient spin to a ball, the width GW1 of the face grooves 10 is preferably at least 0.50 mm, more preferably at least 0.55 mm, still more preferably at least 0.60 mm.

The width GW1 of the face grooves 10 denotes a distance between edges 10*e*, 10*e* measured by the 30 degree method of measurement set in the R&A test protocol.

The pitch SW of disposing the face grooves 10 is constant in each of the club heads 3. The pitch SW is determined based on the golf rules according to which the distance between edges of adjacent grooves must not less than three times the width of the grooves, and not less than 0.075 inches (1.905 mm). From the viewpoint of surely exhibiting the frictional force produced by the face grooves 10, the pitch SW is preferably at least 2.8 mm, more preferably at least 3.0 mm, still more preferably at least 3.3 mm. On the other hand, if the pitch SW is too large, the number of grooves may be decreased to decrease the frictional force to be generated and, therefore, the pitch SW is preferably at most 4.3 mm, more preferably at most 4.0 mm, still more preferably at most 3.8 mm.

In the embodiment shown in the drawings, the auxiliary grooves 11 are disposed in substantially a whole area of the face 4 excepting portions of the face grooves 10. Furthermore, the auxiliary grooves 11 are disposed so as not to intersect each other. The auxiliary grooves 11 have a smaller depth "d2" and a smaller width "GW2" than those of the face grooves 10. The auxiliary grooves 11 must be those providing a surface having a surface roughness such that it does not exceed a surface roughness of decorative sandblasting or of fine milling.

The depth d2 of the auxiliary grooves 11 must be within the range of 0.005 to 0.025 mm. If the depth d2 is less than 0.005 mm, there is a possibility that the auxiliary grooves cannot sufficiently exhibit an effect of increasing the amount of spin of a ball. Therefore, the depth d2 of the auxiliary grooves 11 is preferably at least 0.010 mm, more preferably at least 0.015 mm. Depth d2 exceeding 0.025 mm will violate the golf rules.

From the same viewpoint as above, the width GW2 of the auxiliary grooves 11 is preferably at least 0.10 mm, more preferably at least 0.15 mm, still more preferably at least 0.20 mm. As to the upper limit thereof, the width GW2 is preferably at most 0.50 mm, more preferably at most 0.45 mm, still more preferably at most 0.40 mm.

The auxiliary grooves 11 in this embodiment have a V-shaped cross section. However, the auxiliary grooves 11 may have various cross sectional shapes, e.g., approximately trapezoidal shape having a width decreasing toward the groove bottom, circular arc and combinations thereof, like the face grooves 11.

Preferably, the auxiliary grooves 11 are disposed at regular intervals. It is preferable that pitch HW of disposing the grooves 11, i.e., distance between the center lines of adjacent auxiliary grooves 11, is smaller than the pitch SW for the face grooves 10, whereby more auxiliary grooves 11 can be stably brought into contact with a ball to increase the amount of spin imparted to the ball. In particular, it is preferable that the pitch HW of the auxiliary grooves 11 is at least 0.30 mm, especially at least 0.35 mm, more especially at least 0.40 mm, and it is at most 0.70 mm, especially at most 0.65 mm, more especially at most 0.60 mm.

Figure 7:
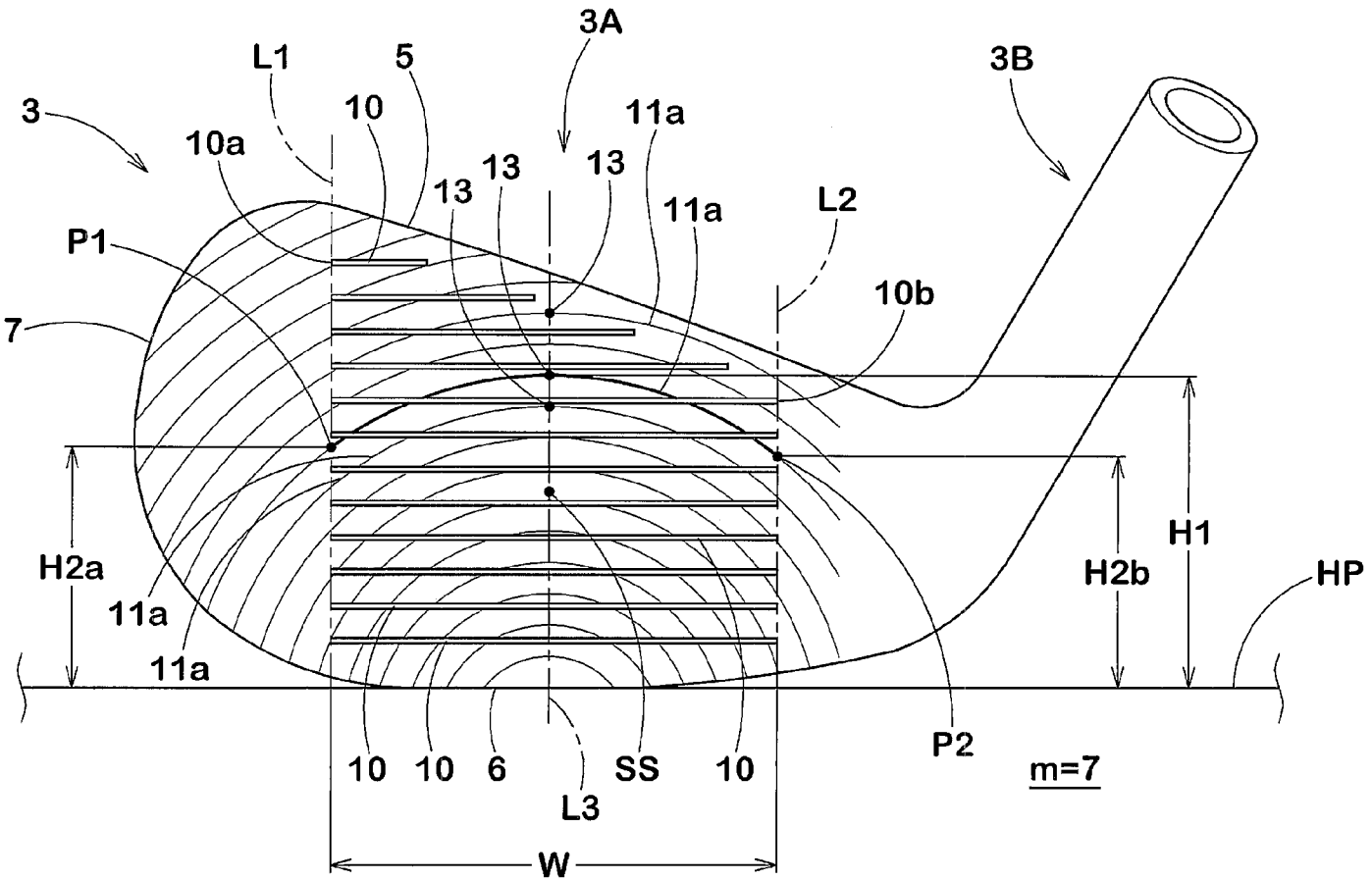
FIG. 7 is a front view of a club head placed on a horizontal plane in the state that the face is perpendicular to the horizontal plane.

FIG. 7 shows a front view of the club head placed on a horizontal plane in a vertical face state. The term "vertical face state" denotes that the face is perpendicular to the horizontal plane, more specifically that the club head is placed on the horizontal plane HP in the standard state and is then rotated around a horizontal line included in the vertical plane VP up to a loft angle of 0°. In the vertical face state, the auxiliary grooves 11 include a plurality of first auxiliary grooves 11*a* extending in at least a region between the toe side line L1 and the heel side line L2 (hereinafter referred to as "L1-L2 region"). Such first auxiliary grooves 11*a* are preferred in that frequent contact thereof with a ball can be expected. Each of the first auxiliary grooves 11*a* may be severed into segments by the auxiliary grooves 11 so long as it extends at least between the toe side and heel side lines L1 and L2.

Each of the first auxiliary grooves 11*a* includes, in the L1-L2 region, a curved groove convex upward such that a line descends from a peak 13 located at the highest position toward both the toe side line L1 and the heel side line L2.

The first auxiliary grooves 11*a* used in this embodiment extend in the form of arcs disposed concentrically. Preferably, such arc-like first auxiliary grooves 11*a* have their peaks on a vertical line L3 passing through the sweet spot SS.

An average degree of curvature θi (i=1 to n) of the first auxiliary grooves 11*a* of the respective club heads is calculated according to the following equation (1). In the present invention, it is required that the thus calculated average degrees of curvature θ1 to θn of the club heads included in the golf club set satisfy the following equations (2) and (3):

$$\theta i=\Sigma\{(H1j-H2j)/W\}/m \ (j=1 \text{ to } m) \quad (1)$$

$$\theta 1<\theta n \quad (2)$$

$$\theta 1\leqq\theta 2\leqq \ldots \leqq\theta n \quad (3)$$

wherein:

H1*j* is a height of the peak 13 of a j-th first auxiliary groove 11*a* from the horizontal plane HP in which "j" is an integer of 1 to m, H2*j* is an average value between a height H2*aj* from the horizontal plane HP of an intersection point P1 of the j-th first auxiliary groove 11*a* with the toe side line L1 and a height H2*bj* from the horizontal plane HP of an intersection point P2 of the j-th first auxiliary groove with the heel side line L2, i.e., H2*j*=(H2*aj*+H2*bj*)/2, W is a horizontal distance between the toe side line L1 and the heel side line L2, "m" is a total number of the first auxiliary grooves 11*a* included in each of the club heads, and θi is an average degree of curvature of the first auxiliary grooves 11*a* of each of the club heads, and the suffix "i" is an integer of 1 to "n" given to the club heads in order of loft angle β from a club head having the smallest loft angle β, in which "n" is a total number of the golf clubs included in the golf club set.

By the equation (1) is calculated the average degree of curvature θ of the first auxiliary grooves 11*a* of each of the club heads included in the golf club set. The larger the average degree of curvature θ, more sharply the first auxiliary grooves 11*a* curve and the angle of the grooves to the toe-heel direction is larger on toe and heel sides of the face. On the contrary, the smaller the average degree of curvature θ, the smaller the angle of the grooves to the toe-heel direction on toe and heel sides of the face.

The iron-type golf club set of the present invention satisfies the equations (2) and (3). In the golf club set of the embodiment shown in the drawings, a long iron having a smaller loft angle has a smaller average degree of curvature θ of the first auxiliary grooves 11*a* than that of a short iron having a larger loft angle. The smaller the loft angle, the smaller the average degree of curvature θ, and the larger the loft angle, the larger the average degree of curvature θ.

As stated above, in case of long irons, mis-shots such as toe hit and heel hit are easy to occur. In such mis-shots, a golf ball slips or moves on the face 4 in a direction as shown by an arrow A or B in FIG. 1A. The angle γ of the moving direction to a vertical direction (i.e., direction perpendicular to face grooves 10) is relatively small. In contrast, in case of short irons, a golf ball is frequently hit with a face intentionally opened or closed greatly. In such shots, a golf ball slips or moves on the face 4 in a direction as shown by an arrow C or D in FIG. 1C. The angle δ of the moving direction C or D to a vertical direction (i.e., direction perpendicular to face grooves 10) is larger than that of the long irons.

According to the present invention, the first auxiliary grooves 11*a* can be arranged, in respective golf clubs of a golf club set, at such an angle as approaching right angle to the ball moving directions A to D by forming the first auxiliary grooves 11*a* of long irons to have a smaller average degree of curvature θi and forming the first auxiliary grooves 11*a* of short irons to have a larger average degree of curvature θi. Thus, the amount of spin of a ball can be more effectively increased by disposing the auxiliary grooves 11 at approximately right angles to the ball slipping direction. Therefore, the iron-type golf club set of the present invention has the advantages that for mis-shots by long irons, variation in spin amount of ball can be reduced to stabilize the flight distance, and for intentional shots by short irons, the amount of spin can be effectively increased to reduce variation in flight distance, thus enhancing the accuracy of shots.

It is preferable that the golf club set of the present invention satisfies the following equation (4):

$$\theta 1<\theta 2< \ldots <\theta n \quad (4)$$

That is to say, it is effective that as the loft angle β increases, the average degree of curvature θ becomes larger (i.e., $\theta_i<\theta_{i+1}$).

It is preferable that the average degree of curvature θ1 of club head 3 having the smallest loft angle β is at least 0.02, especially at least 0.03, more especially at least 0.04, and is at most 0.10, especially at most 0.09, more especially at most 0.08. If the average degree of curvature θ1 is less than 0.02 or more than 0.10, the angle between the ball slipping direction at mis-shots and the first auxiliary grooves 11*a* gets away from right angle, so the effect of suppressing variation in ball spin amount tends to lower.

Further, it is preferable that the average degree of curvature θn of club head 3 having the largest loft angle β in the golf club set is at least 0.11, especially at least 0.13, more especially at least 0.14, and is at most 0.35, especially at most 0.32, more especially at most 0.30. If the average degree of curvature θn is less than 0.11 or more than 0.35, the angle between the ball slipping direction at intentional shots with a face opened or closed markedly and the first auxiliary grooves 11*a* gets away from right angle, so the amount of spin of a ball tends to reduce to lower the accuracy of shots.

Further, it is preferable that a ratio θn/θ1 of the average degree of curvature θn of a club head having the largest loft angle to the average degree of curvature θ1 of a club head having the smallest loft angle is at least 1.5, especially at least 2.5, and is at most 7.5, especially at most 6.5, whereby an optimum spin control can be made according to the loft angle in the golf club set of the present invention.

The face grooves 10 and the auxiliary grooves 11 can be formed, for example, by a press work wherein a marking stamp with projections having an inverted shape for the respective grooves is pressed onto the face 4 or a cutting work using a lathe or the like. The press work is preferred from the viewpoint of productivity.

In case of forming the face grooves 10 and the auxiliary grooves 11 by the press work, the grooves 10 and 11 may be formed simultaneously in a single step or may be formed in separate steps. The former method is preferred from the viewpoint of productivity.

Figure 8A:
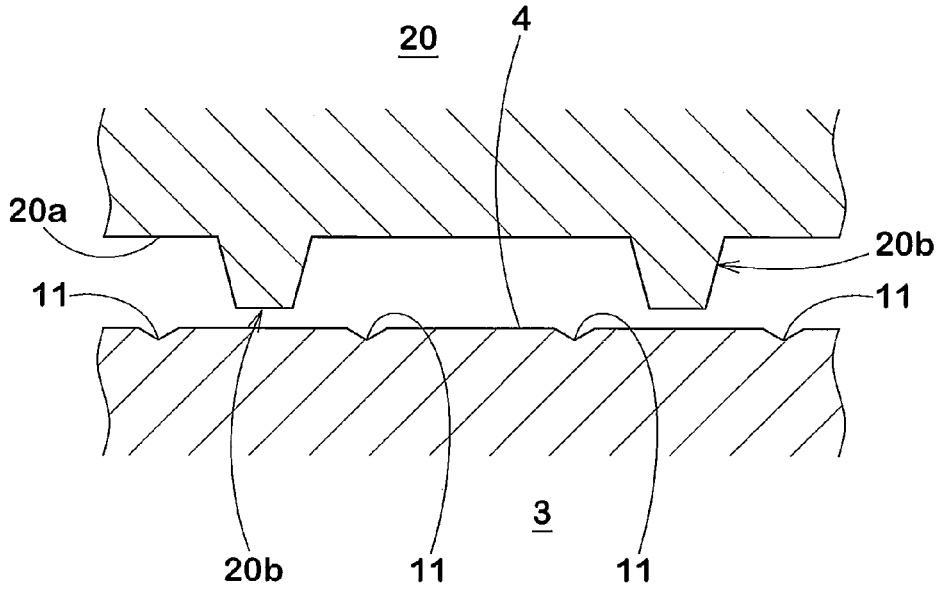
FIGS. 8A and 8B are cross sectional views showing steps of forming face grooves and auxiliary grooves.
Figure 8B:
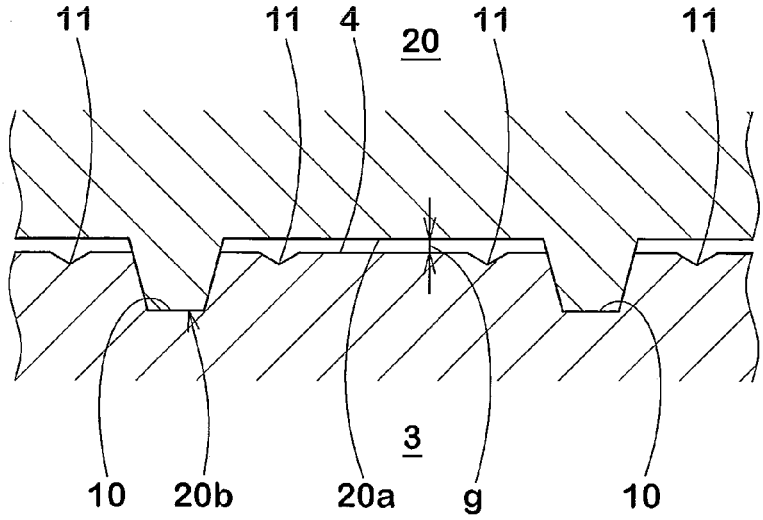

In case of forming the face grooves 10 and the auxiliary grooves 11 in separate steps, the auxiliary grooves 11 may be firstly formed or the face grooves 10 may be firstly formed. In case of firstly forming the face grooves 10 and then forming the auxiliary grooves 11, a part of the face material may be plastic-deformed by press working for forming the auxiliary grooves 11 to protrude into the previously formed face grooves 10. Therefore, preferably, grooves having a small depth, namely the auxiliary grooves 11, are firstly formed by pressing a marking stamp or the like to the face 4 and thereafter the face grooves 10 which have a larger depth are formed. An example of such a method of forming the face grooves 10 is shown in FIGS. 8A and 8B.

Marking stamp 20 for forming the face grooves 10 has a molding surface including a main surface 20*a* which is substantially flat, and protruding portions 20*b* each protruding from the main surface 20*a*. The protruding portions 20*b* of the stamp 20 are perpendicularly thrust into the face 3 to form the face grooves 10 in such a manner that the stamp 20 is pressed against the face 3 having the previously formed auxiliary grooves 11 so as to bring only the protruding portions 20*b* into contact with the face 3, as shown in FIG. 8B. By stamping in such a manner, the main surface 20*a* of the stamp 20 does not come into contact with the face 3 to retain a space "g" between the main surface 20*a* and the face 3, whereby the face grooves 10 can be formed while effectively preventing the auxiliary grooves 11 from being crushed by the main surface 20*a*. Further, since the stamping for the face grooves 10 is conducted after forming the auxiliary grooves 11, good-looking face grooves 10 can be formed without cutting, crushing or deforming edges and bottom corners of the face grooves 10.

Figure 9A:
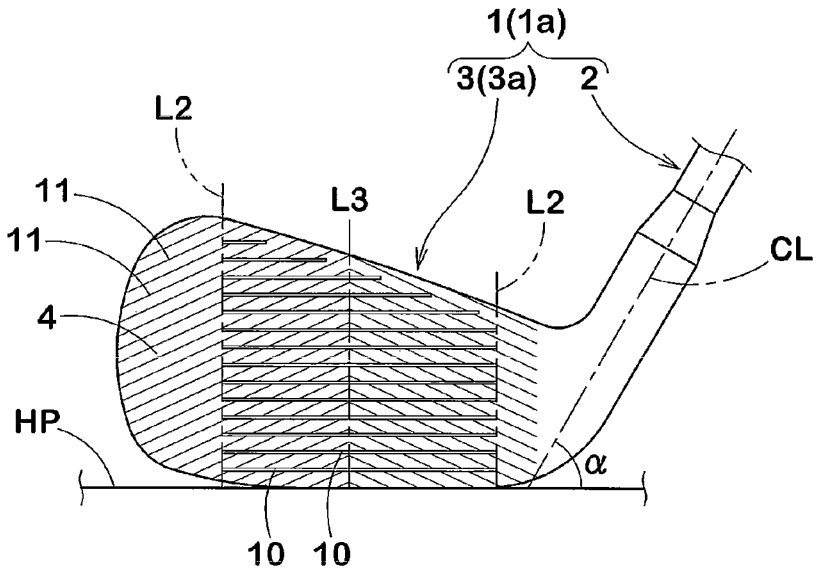
FIGS. 9A and 9B are front views of club heads showing another embodiment of the present invention.
Figure 9B:
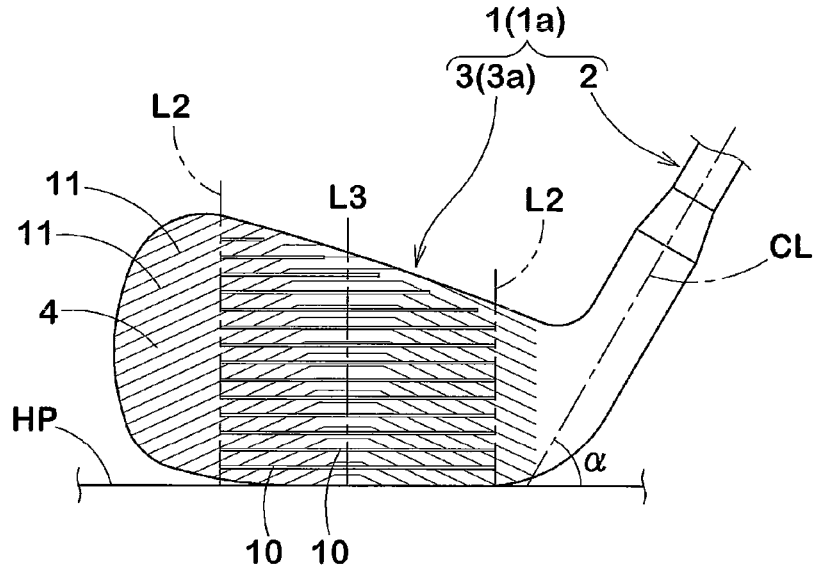

In the embodiment explained above, the auxiliary grooves 11 extend in the form of arcs disposed concentrically. However, the auxiliary grooves 11 may be in the form of, for example, a v-shape or an approximately trapezoidal shape, as shown in FIGS. 9A and 9B, so long as inclination parts of the auxiliary grooves 11 of the respective club heads included in the club set have a relationship corresponding to the relationship of the average degrees of curvature θi.

While preferable embodiments of the present invention have been described with reference to the drawings, it goes without saying that the present invention is not limited to only such embodiments and various changes and modifications may be made.

The present invention is more specifically described and explained by means of the following Example and Comparative Examples. It is to be understood that the present invention is not limited to these Examples.

Example 1 and Comparative Examples 1 to 3

A set of iron-type golf clubs was produced based on the specifications shown in Table 1 and FIG. 7. Each of club heads was produced by forging a soft iron (S25C) to give a club head, then forming auxiliary grooves in the surface of the face by a press work, and then forming face grooves by a press work so as not to deform the auxiliary grooves.

Common specifications of the face grooves and the auxiliary grooves to all examples are as described below.

<Face Grooves>

Groove width GW1: 0.7 mm

Disposing pitch SW: 3.60 mm

Groove depth d1: 0.35 mm

<Auxiliary Grooves>

Groove width GW2: 0.3 mm

Disposing pitch HW: 0.5 mm

Groove depth d2: 0.02 mm

Testing methods are as follows:

<Test of Curving a Ball>

Figure 10B:
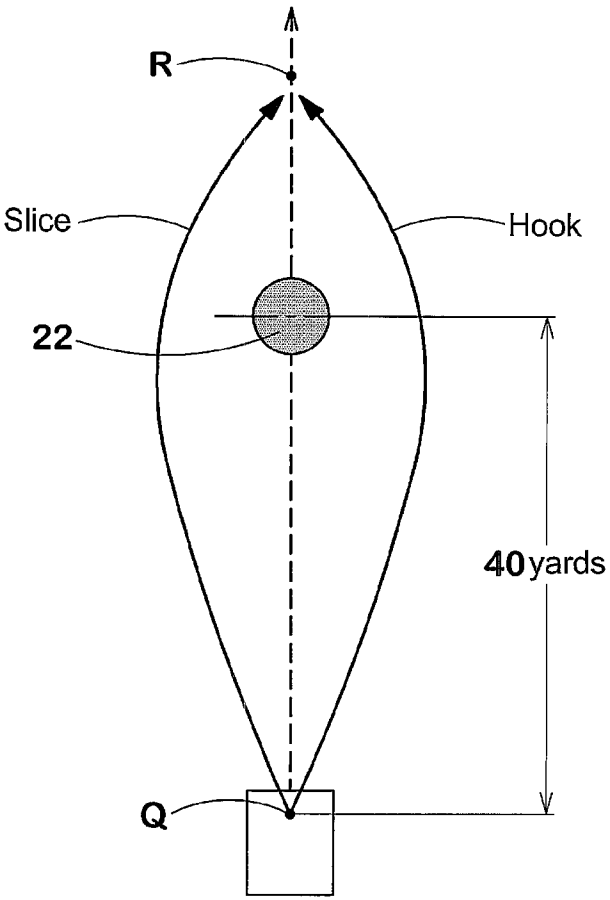
FIGS. 10A and 10B are diagrams illustrating a hitting test.
Figure 10A:
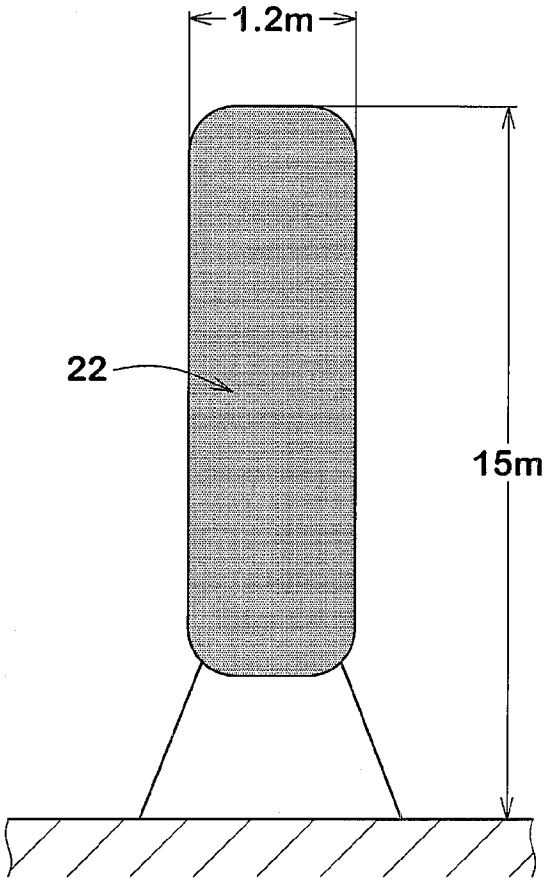

As shown in FIGS. 10A and 10B, a balloon 22 was placed as an obstacle in a hitting test course at a position 40 yards away from a hitting position Q. A hitting test of golf clubs was conducted to evaluate a degree of curving of a ball, wherein a slice or hook spin is intentionally imparted to a ball to avoid the obstacle 22 and to reach a target position R. A front view of the balloon 22 is shown in FIG. 10A The width of the balloon 22 was 1.2 m and the height thereof from the ground was 15 mm.

The hitting test was conducted using three piece golf balls commercially available under the trade mark "SRIXON" Z-UR made by SRI Sports Limited as follows: Five golf balls were hit by each of ten golfers having a handicap of 0 to 9 with each golf club under both a dry face condition and a wet face condition in which water was sprayed onto the face and for both a slice shot and a hook shot (20 golf balls in total per one of the golf clubs). The amount of swerve from the target line to a ball stop position in a transverse direction to the target line was measured. The amount of swerve is shown by a positive value for both the swerve to the right and the swerve to the left. The smaller the value, the higher the controllability or accuracy of shots.

<Variation in Flight Distance>

Ten pieces of the above-mentioned golf balls were hit straight by each of the ten golfers with each golf club under each of the dry and wet face conditions. Variation in flight distance to the target R (namely amount of swerve in flight distance to the target R along the target line) was measured. The amount of swerve is shown by a positive value for both a shot over the target and a shot short of the target. An average value of the amounts of swerve measured for 100 balls was obtained. The smaller the value, the higher the stability of flight distance.

The test results are shown in Table 1.

TABLE 1

| | Loft angle β1 (degree) | 21 | 27 | 34 | 42 | 51 |
|---|---|---|---|---|---|---|
| Ex. 1 | Average degree of curvature θi of auxiliary grooves | 0.05 | 0.05 | 0.10 | 0.10 | 0.20 |
| | Test results (unit: yard) | | | | | |
| | Curving test (dry) | 22.4 | 19.6 | 16.3 | 13.4 | 10.7 |
| | Curving test (wet) | 27.2 | 22.8 | 20.1 | 17.7 | 15.2 |
| | Variation in flight distance (dry) | 13.9 | 10.8 | 9.3 | 7.8 | 7.4 |
| | Variation in flight distance (wet) | 18.9 | 15.7 | 13.2 | 11.2 | 10.9 |
| Com. Ex. 1 | Average degree of curvature θi of auxiliary grooves | —* | — | — | — | — |
| | Test results (unit: yard) | | | | | |
| | Curving test (dry) | 24.6 | 21.3 | 18.1 | 15.0 | 13.2 |
| | Curving test (wet) | 30.3 | 26.0 | 23.5 | 20.5 | 18.8 |
| | Variation in flight distance (dry) | 15.2 | 12.5 | 10.7 | 8.9 | 7.8 |
| | Variation in flight distance (wet) | 21.6 | 17.7 | 15.0 | 13.2 | 11.4 |
| Com. Ex. 2 | Average degree of curvature θi of auxiliary grooves | 0.05 | 0.05 | 0.05 | 0.05 | 0.05 |
| | Test results (unit: yard) | | | | | |
| | Curving test (dry) | 22.4 | 19.6 | 16.5 | 13.8 | 11.3 |
| | Curving test (wet) | 27.2 | 22.8 | 20.4 | 17.9 | 15.7 |
| | Variation in flight distance (dry) | 13.9 | 10.8 | 9.1 | 7.7 | 6.6 |
| | Variation in flight distance (wet) | 18.9 | 15.7 | 12.8 | 10.9 | 9.7 |
| Com. Ex. 3 | Average degree of curvature θi of auxiliary grooves | 0.20 | 0.20 | 0.20 | 0.20 | 0.20 |
| | Test results (unit: yard) | | | | | |
| | Curving test (dry) | 22.3 | 19.2 | 16.0 | 13.2 | 10.7 |
| | Curving test (wet) | 26.9 | 22.6 | 19.9 | 17.5 | 15.2 |
| | Variation in flight distance (dry) | 15.0 | 11.8 | 9.9 | 7.9 | 7.4 |
| | Variation in flight distance (wet) | 20.1 | 16.8 | 13.9 | 11.6 | 10.9 |

*No auxiliary groove was formed.

What is claimed is:

1. A set of iron-type golf clubs comprising "n" pieces of iron-type golf clubs having club heads with different loft angles wherein "n" is an integer of 3 or more, each of the club heads having a ball-hitting face provided with a plurality of face grooves extending in a club head's toe-heel direction and having a depth of 0.200 to 0.508 mm and a plurality of auxiliary grooves having a depth of 0.005 to 0.025 mm, the auxiliary grooves including a plurality of first auxiliary grooves extending, in a vertically-placed face state that a club head is placed on a horizontal plane at prescribed line and loft angles given to the club head and is then tilted forward up to a loft angle of 0°, in at least a region between a toe side line extending at right angles to the face grooves with passing at toe side ends of the face grooves and a heel side line extending at right angles to the face grooves with passing at heel side ends of the face grooves, each of the first auxiliary grooves being formed, in said region, into a curved groove convex upward such that a curve descends from a peak toward both the toe side line and the heel side line, and an average degree of curvature θi calculated according to the following equation (1) of the first auxiliary grooves of each of the club heads satisfying the following equations (2) and (3):

$$\theta i=\Sigma\{(H1j-H2j)/W\}/m \ (j=1 \text{ to } m) \quad (1)$$

$$\theta 1<\theta n \quad (2)$$

$$\theta 1\leqq\theta 2\leqq \ldots \leqq\theta n \quad (3)$$

wherein:

H1*j* is a height of the peak of a j-th first auxiliary groove from the horizontal plane, H2*j* is an average value between a height H2*aj* from the horizontal plane of an intersection point of the j-th first auxiliary groove with the toe side line and a height H2*bj* from the horizontal plane of an intersection point of the j-th first auxiliary groove with the heel side line, i.e., H2*j*=(H2*aj*+H2*bj*)/2, W is a horizontal distance between the toe side line and the heel side line, "m" is a total number of the first auxiliary grooves included in each of the club heads, and θi is an average degree of curvature of the first auxiliary grooves of each of the club heads, and the suffix "i" is an integer of 1 to "n" given to the club heads in order of loft angle from a club head having the smallest loft angle, in which "n" is a total number of the golf clubs included in the golf club set.

2. A set of iron-type golf clubs according to claim 1, which satisfies the following equation (4):

$$\theta 1<\theta 2< \ldots <\theta n \quad (4).$$

3. A set of iron-type golf clubs according to claim 1, wherein the first auxiliary grooves are in the form of an arc.

4. A set of iron-type golf clubs according to claim 1, wherein the average degree of curvature θ1 of the club head having the smallest loft angle is from 0.02 to 0.10.

5. A set of iron-type golf clubs according to claim 1, wherein the average degree of curvature θn of the club head having the largest loft angle is from 0.11 to 0.35.

6. A set of iron-type golf clubs according to claim 1, wherein a ratio θn/θ1 of the average degree of curvature θn of the club head having the largest loft angle to the average degree of curvature θ1 of the club head having the smallest loft angle is from 1.5 to 7.5.

7. A set of iron-type golf clubs according to claim 1, wherein the lowest loft angle β in the golf club set is from 19 to 27°, and the largest loft angle β in the golf club set is from 44 to 60°.

8. A set of iron-type golf clubs according to claim 1, wherein the auxiliary grooves are disposed so as not to intersect each other.

9. A set of iron-type golf clubs according to claim 1, wherein the auxiliary grooves have a width of 0.10 to 0.50 mm.

10. A set of iron-type golf clubs according to claim 1, wherein a pitch HW of disposing the auxiliary grooves which is a distance between the center lines of adjacent auxiliary grooves, is smaller than a pitch SW of disposing the face grooves which is a distance between the center lines of adjacent face grooves.

11. A set of iron-type golf clubs according to claim 1, wherein a pitch HW of disposing the auxiliary grooves which is a distance between the center lines of adjacent auxiliary grooves, is from 0.30 to 0.70 mm.

* * * * *